US008469481B2

(12) United States Patent
Tendler et al.

(10) Patent No.: US 8,469,481 B2
(45) Date of Patent: Jun. 25, 2013

(54) METHOD FOR DETERMINING THE CHARACTER WIDTH OF CHARACTERS CONSTRUCTED FROM PRINTED DOTS IN A PRINTING OR COPYING DEVICE

(75) Inventors: Felix Tendler, Haar (DE); Joseph Knott, Tutzing (DE); Markus Diezi, Schwäbisch Gmünd (DE)

(73) Assignee: Océ Printing Systems GmbH, Poing (DE)

( * ) Notice: Subject to any disclaimer, the term of this patent is extended or adjusted under 35 U.S.C. 154(b) by 221 days.

(21) Appl. No.: 13/000,641

(22) PCT Filed: Jun. 30, 2009

(86) PCT No.: PCT/EP2009/058185
§ 371 (c)(1), (2), (4) Date: Feb. 15, 2011

(87) PCT Pub. No.: WO2010/000739
PCT Pub. Date: Jan. 7, 2010

(65) Prior Publication Data

US 2011/0157273 A1 Jun. 30, 2011

(30) Foreign Application Priority Data

Jun. 30, 2008 (DE) ..... 10 2008 030 972

(51) Int. Cl.
*B41J 29/38* (2006.01)
*B41J 29/393* (2006.01)
*B41J 2/015* (2006.01)

(52) U.S. Cl.
USPC ..... 347/19; 347/9; 347/20

(58) Field of Classification Search
USPC ..... 347/6, 10, 9, 19–20
See application file for complete search history.

(56) References Cited

U.S. PATENT DOCUMENTS

| | | | |
|---|---|---|---|
| 4,277,162 | A | 7/1981 | Kasahara et al. |
| 4,868,600 | A | 9/1989 | Hays et al. |
| 6,994,412 | B2 | 2/2006 | Westdijk et al. |
| 7,016,620 | B2 | 3/2006 | Maess et al. |
| 7,128,382 | B2 | 10/2006 | Velde |

(Continued)

FOREIGN PATENT DOCUMENTS

| | | | |
|---|---|---|---|
| DE | 2928402 | A1 | 1/1980 |
| DE | 102006058580 | A1 | 6/2008 |
| EP | 1308279 | A2 | 5/2003 |
| EP | 1391302 | A1 | 2/2004 |

(Continued)

*Primary Examiner* — Jason Uhlenhake
(74) *Attorney, Agent, or Firm* — Schiff Hardin LLP

(57) ABSTRACT

In a method to determine a character width of characters from printed dots in a printing or copying device the printed dots are generated at a location of individual printed elements of a print raster made up of printed elements. In a first raster cell of the print raster a first test pattern is generated that does not cover an entire area from multiple printed dots, and the first raster cell is measured for areal coverage. In a second raster cell of the print raster a second test pattern is generated that does not cover an entire area in which the printed dots are arranged at least in part at different printed element locations in comparison to the first test pattern, and the second test pattern is measured for areal coverage. A ratio of the areal coverages is calculated and the printed dot size is calculated with aid of the ratio. Alternatively instead of measuring areal coverage with respect to the first and second test patterns, toner quantity is measured.

20 Claims, 2 Drawing Sheets

U.S. PATENT DOCUMENTS

| | | | | |
|---|---|---|---|---|
| 7,260,334 | B2 | 8/2007 | Winter et al. | |
| 7,327,503 | B2 | 2/2008 | Yashima et al. | |
| 7,422,304 | B2 | 9/2008 | Hosono | |
| 8,185,004 | B2 | 5/2012 | Schwarz-Kock et al. | |
| 2001/0022596 | A1* | 9/2001 | Korol | 347/10 |
| 2005/0237348 | A1 | 10/2005 | Campbell | |
| 2007/0237534 | A1 | 10/2007 | Harush et al. | |

FOREIGN PATENT DOCUMENTS

| | | | |
|---|---|---|---|
| EP | 1398162 | A1 | 3/2004 |
| EP | 1616705 | A1 | 1/2006 |
| WO | 03012552 | A2 | 2/2003 |
| WO | 2006046224 | A2 | 5/2006 |
| WO | 2008071741 | A1 | 6/2008 |

* cited by examiner

METHOD FOR DETERMINING THE CHARACTER WIDTH OF CHARACTERS CONSTRUCTED FROM PRINTED DOTS IN A PRINTING OR COPYING DEVICE

BACKGROUND

The development of charge images of images to be printed that are applied on a charge image carrier (for example a photoconductor drum or a photoconductor belt) by a character generator (for example an LED character generator) in an electrophotographic printing or copying device is known, for example according to the toner jump principle (see for example U.S. Pat. No. 4,868,600). In this principle, in the development region a toner cloud of toner particles is generated in the intervening space between developer roller (jump roller) and charge image carrier via application of an alternating voltage and/or a direct voltage (bias voltage), from which toner cloud toner particles cross over onto the charge image carrier, corresponding to the charge images, and ink the charge image carrier.

The charge images on the charge image carrier can be generated by an LED character generator. This can recharge individual output pixels or PELs (printed elements) via exposure, which individual output pixels or PELs are in a print raster made up of addressable output pixels on the charge image carrier depending on the character to be printed. These PELs are then developed into printed dots via the developer station. A printed dot is thus the dot that is physically printed at the location of the PEL; it is normally larger in area than the corresponding PEL. The printed pattern can be divided up into raster cells; one raster cell is thereby a two-dimensional matrix of PELs.

In operation it is necessary to establish the character width of a character. What is thereby to be understood by character width is how wide or how fat a printing device outputs a predetermined character. The appearance of the print image and the toner consumption can be affected by varying the character width.

The character width can be measured with the aid of an optical reflex sensor that measures the (infrared) light cast back by the surface of the charge image carriers. Integration thereby takes place over a surface of a few square millimeters in size (a few thousand printed dots). In principle the character width can be determined by measuring a print raster on the charge image carrier. It applies that: strong reflection=small printed dots=narrow characters, weak reflection=large points=wide characters. Since the reflection is different for different toner colors, the character width can only be measured depending on the toner color via direct measurement of a print raster with a reflection sensor. Given different colors this is difficult, in particular given mixed colors. The contamination of the sensor and the contamination or discoloration of the charge image carrier can additionally adulterate the measurement.

The measurement can also take place in that a toner mark is generated on the charge image carrier, the toner quantity of which toner mark is determined via capacitive toner quantity measurement. The toner quantity changes depending on the printed dot diameter or the line width of the toner mark.

Manipulated variables for the printed dot and line variation in characters that are to be printed are, for example, the bias voltage at the jump roller, the charging/dischargind potential of the charge image carrier, and properties of the developer mixture.

The measurement of a toner mark with an optical reflex sensor is known from U.S. Pat. No. 7,016,620 B2, for example; the measurement of a toner mark with a capacitive toner quantity sensor is known from U.S. Pat. No. 7,260,334 B2.

SUMMARY

It is an object to specify a method with which the character width of characters printed with a printing or copying device can be determined with the aid of a sensor, independent of the print color and the contamination of the sensor.

In a method to determine a character width of characters from printed dots in a printing or copying device the printed dots are generated at a location of individual printed elements of a print raster made up of printed elements. In a first raster cell of the print raster a first test pattern is generated that does not cover an entire area from multiple printed dots, and the first raster cell is measured for areal coverage. In a second raster cell of the print raster a second test pattern is generated that does not cover an entire area in which the printed dots are arranged at least in part at different printed element locations in comparison to the first test pattern, and the second test pattern is measured for areal coverage. A ratio of the areal coverages is calculated and the printed dot size is calculated with aid of the ratio. Alternatively instead of measuring areal coverage with respect to the first and second test patterns, toner quantity is measured.

DESCRIPTION OF THE PREFERRED EMBODIMENTS

Figure 1:
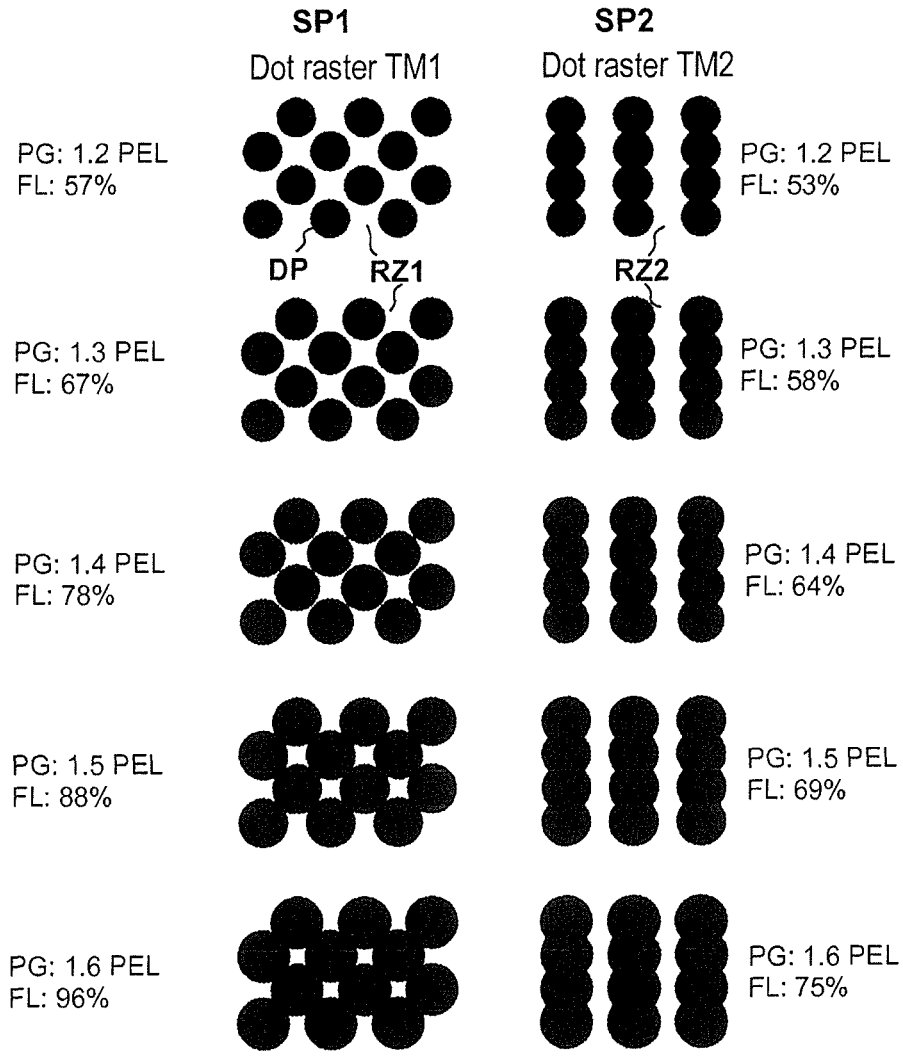
FIG. 1 illustrates examples of areal coverages given different printed dot sizes (expressed in PELs) in two different test patterns.

For the purposes of promoting an understanding of the principles of the invention, reference will now be made to the preferred embodiments/best mode illustrated in the drawings and specific language will be used to describe the same. It will nevertheless be understood that no limitation of the scope of the invention is thereby intended, and such alterations and further modifications in the illustrated method and such further applications of the principles of the invention as illustrated as would normally occur to one skilled in the art to which the invention relates are included.

The method according to the preferred embodiments can be used both in electrophotographic printing and in inkjet printing. In the following the preferred embodiments are explained in connection with electrophotographic printing without the preferred embodiments being thereby limited to this application case.

The method according to the preferred embodiments assumes that the characters are constructed from printed dots and that individual PELs of a print raster made up of PELs are developed into printed dots to generate characters.

In a first solution method the problem posed above is then solved with the following steps:

in a first raster cell of the print raster a first test pattern of printed dots is generated and this is measured with regard to its areal coverage, in a second raster cell of the print raster a second test pattern is generated in which the printed dots are arranged at least in part at different PEL locations in comparison to the first test pattern, and the second test pattern is measured with regard to its areal coverage, the ratio of the areal coverages of the first and second test patterns is calculated and the printed dot size is calculated with the aid of the ratio. A second solution method has the following steps:

in a first raster cell of the print raster a first test pattern is generated from printed dots and this is measured with regard to its toner quantity, in a second raster cell of the printed raster a second test pattern is generated in which the printed dots are arranged at least in part at different PEL locations in comparison to the first test pattern, and the second test pattern is measured with regard to its toner quantity, the ratio of the toner quantities of the first and second test patterns is calculated and the printed dot size is calculated with the aid of the ratio.

For example, the calculation of the printed dot size can take place via a stored table or a formula in which is contained the dependency of the printed dot size on the ratios of the areal coverages or of the toner quantities. If the printed dot size is then known, the character width can be concluded from this.

In the first solution method, the following steps can be executed to generate the table:

the first test patterns are created in succession with printed dots of predetermined but different dot sizes; the respective areal coverages of the first test patterns are thereby determined as first measurement results, the second test patterns are generated in succession with printed dots of the predetermined different dot sizes; the respective areal coverages of the second test patterns that thereby result are determined as second measurement results, the ratios of the first and second measurement results are calculated, the ratios are stored as a table depending on the size of the predetermined printed dots.

In the print operation the printed dot size can then be determined from the table after measurement of the areal coverages of both test patterns.

In the second solution method the table can be generated with the following steps:

the first test patterns are created in succession with printed dots of predetermined but different dot sizes; the respective toner quantities of the first test patterns are determined as first measurement results, the second test patterns are generated in succession with printed dots of the predetermined different dot sizes; the respective toner quantities of the second test patterns are determined as second measurement results, the ratios of the first and second measurement results are calculated, the ratios are stored as a table depending on the size of the predetermined printed dots.

In the print operation the printed dot size can then be determined from the table after measurement of the toner quantities of both test patterns.

For example, a checkerboard pattern can be selected as a first test pattern. The second test pattern can then be realized as a line pattern, for example. However, test patterns with a different arrangement of the printed dots are also possible, but the requirement is that the first and second test patterns differ in the arrangement of the printed dots.

If the table has been saved in a memory of a printer controller, with the aid of the table the printed dot size can be read from the test patterns after measurement of the areal coverages of the test patterns and calculation of their ratio or after measurement of the toner quantities of the test patterns and calculation of their ratio, and the character width of the printed characters can be determined from this. The test patterns can thereby be arranged as toner marks on the charge image carrier.

In the first solution method the first test pattern and the second test pattern are applied on a photoconductor belt (for example) as a charge image carrier; the areal coverages of the two test patterns are measured with an optical reflex sensor; the ratio of the areal coverages is then determined; and the printed dot size is determined with the aid of the ratio from the table and the character width is determined with the aid of the printed dot size.

In the second solution method the first test pattern and the second test pattern are applied on a photoconductor belt (for example) as a charge image carrier; the toner quantities of the two test patterns are measured with a capacitive toner quantity sensor; the ratio of the toner quantities is determined; and with the aid of the ratio from the table the printed dot size is determined, and from the printed dot size the character width is determined.

Two columns SP1, SP2 of raster cells RZ1, RZ2 from a print raster are shown in FIG. 1. A first test pattern TM1 comprised of printed dots DP is arranged in the raster cell RZ1; a second test pattern TM2 comprised of printed dots DP of the same size is arranged in the raster cell RZ2. The test pattern areas of TM1 and TM2 are selected so as to be equal in size. The test patterns TM1 of column SP1 are realized as a checkerboard pattern; and the test patterns TM2 of column SP2 are realized as a line pattern. The test patterns TM1, TM2 are thereby shown with different printed dot sizes in the column direction. At the edge the respective dot sizes are indicated in PEL and the areal coverages that thereby result are indicated in %.

Viewed from top to bottom in the column direction, the areal coverages are indicated in % as an example, beginning with a printed dot size of 1.2 PEL through a printed dot size of 1.6 PEL. For example, the test pattern TM1 has an areal coverage of 57% given a dot size of 1.2 PEL. In contrast to this, the test pattern TM2 has an areal coverage of 53% given a dot size of 1.2 PEL. Or, the test pattern TM1 has an areal coverage of 96% given a dot size of 1.6 PEL; in contrast to this, the test pattern TM2 has an areal coverage of 75%.

The difference in the areal coverages given both test patterns TM1 and TM2 is apparent in FIG. 1. While the printed dots DP overlap in the column direction with increasing printed dot size in the line pattern TM2, given the checkerboard pattern TM1 an overlap of the printed dots only begins as of a dot size of 1.6 PEL. The consequence is that the areal coverage in the checkerboard pattern TM1 outperforms the areal coverage given the line pattern TM2 with increasing printed dot size. The areal coverage of the test pattern is therefore dependent on the arrangement of the printed dots DP in the respective raster cell RZ. The variation of the size of the printed dots DP can be achieved via (for example) adjustment of the bias voltage at the jump roller in the developer station.

Figure 2:
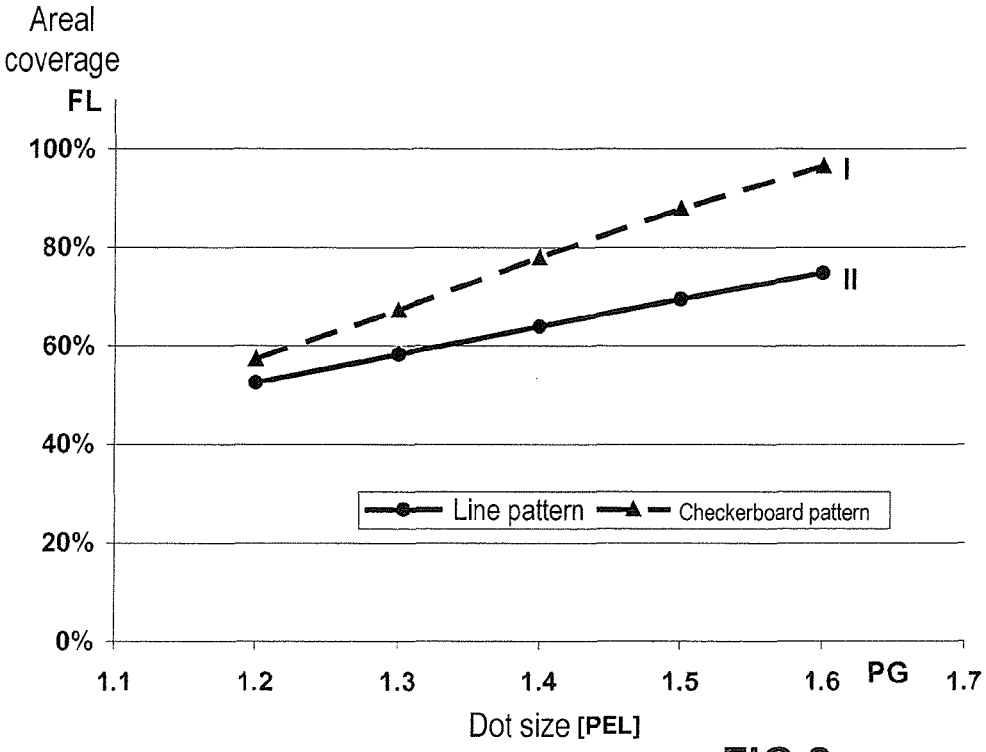
FIG. 2 illustrates a diagram that shows the areal coverages of the two test patterns plotted over the printed dot size.

The result from FIG. 1 has been transferred into a diagram in FIG. 2, which diagram shows the areal coverages FL (in %) of the test patterns TM1 and TM2 plotted over the dot size printing group (expressed in PEL). The curve I shows the curve of the areal coverages in the checkerboard pattern TM1, the curve II the curve of the areal coverages in the line pattern TM2, plotted over the dot size.

Figure 3:
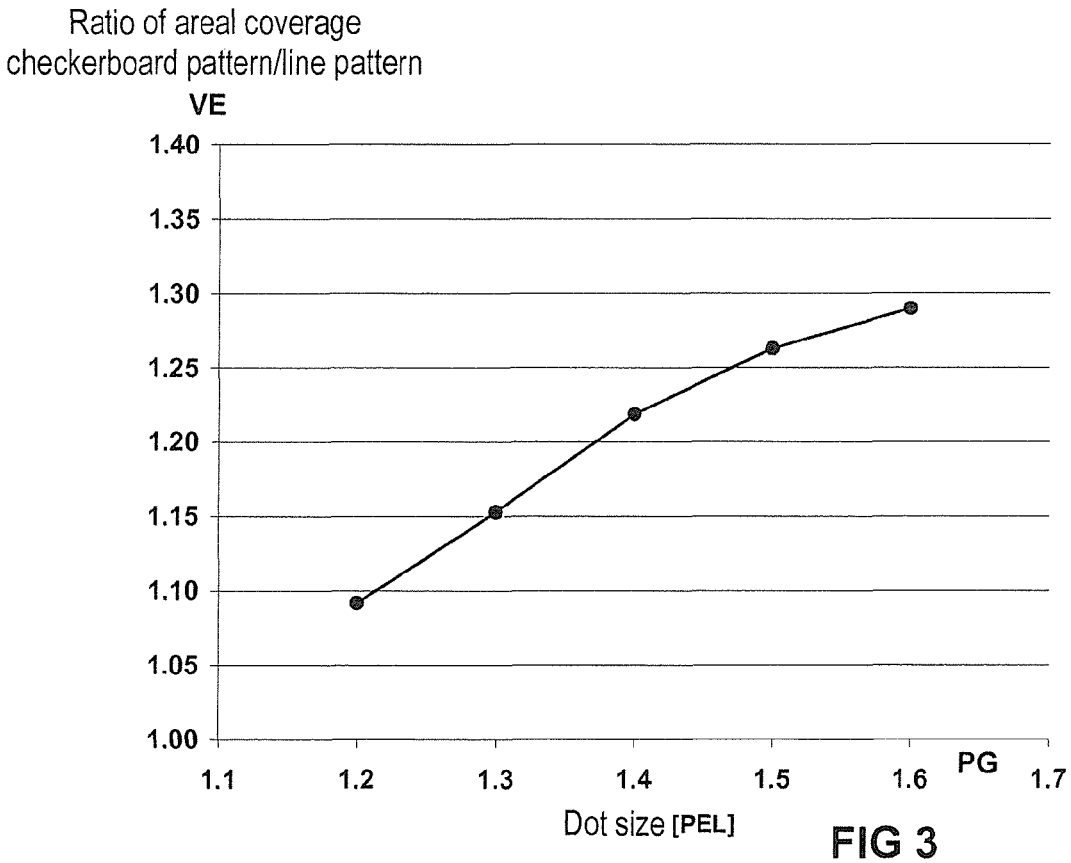
FIG. 3 is a diagram that shows the ratios of the areal coverages of the two test patterns relative to the printed dot size.

If the ratio VE of the areal coverages FL of the test patterns TM1 and TM2 is respectively calculated corresponding to the curve according to FIG. 2, FIG. 3 results. FIG. 3 shows the ratios VE of the areal coverages FL of checkerboard pattern TM1 to line pattern TM2, again plotted over the dot size in PEL. It can be learned from FIG. 3 that, via measurement of the areal coverages FL of test patterns TM1, TM2 applied on a photoconductor corresponding to FIG. 1, the dot size of the printed dot DP that is used can be read out after calculation of the ratio VE of the areal coverages FL of TM1 and TM2, and from this the character width can be concluded. For example, if an areal coverage FL of 67% is measured given a test pattern TM1 applied on a photoconductor, and an areal coverage FL of 58% is measured in a test pattern TM2 that has been generated with the same dot size, the ratio VE yields a value of "1.15" and the dot size PG of 1.3 PEL can be read out from FIG. 3 for this.

If the curve according to FIG. 3 is saved as a table or as a formula in the printer controller, the character width can thus be calculated in the print operation. For this the two test patterns TM1, TM2 according to FIG. 1 must also be generated (for example as toner marks) on the photoconductor with the printed dot size that is used in the printing of the characters; the areal coverages FL of the two test patterns TM1, TM2 must be measured with an optical reflex sensor; the ratio VE must be calculated from this. The dot size PG can then be learned from the table corresponding to FIG. 3. For example, if an areal coverage of 67% of measured given the test pattern TM1 and an areal coverage of 58% is measured given the test pattern TM2, the dot size PG=1.3 PEL is then learned from the table.

Instead of the areal coverage, the method can also be implemented via measurement of the toner quantity of the test pattern. The procedure corresponds to that which was explained above with regard to FIG. 1 through 3. The areal coverage is replaced by the measured toner quantity. The explanations with regard to FIG. 1 through 3 can be referenced for this.

As indicated above, the method can also be used in an inkjet printer, with the assumption that the generation of the characters takes place in printed dots. As described, the size of the printed dots can then be determined from the areal coverages of test patterns.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

We claim as our invention:

1. A method to determine a character width of characters constructed from printed dots in a printing or copying device, in which the printed dots are generated at a location of individual printed elements of a print raster made up of the printed elements, comprising the steps of:

generating in a first raster cell of the print raster a first test pattern that does not cover an entire area from multiple printed dots, and measuring the first raster cell with regard to its printed dot areal coverage to create a first value;

generating in a second raster cell of the print raster a second test pattern that does not cover an entire area and in which printed dots are arranged at least in part at different printed element locations in comparison to the first test pattern, and measuring the second test pattern with regard to its printed dot areal coverage to create a second value; and calculating a ratio of the first and second values of the printed dot areal coverages of the first and the second test patterns and calculating printed dot size with aid of the ratio.

2. The method according to claim 1 in which the individual printed elements of the print raster made up of the printed elements are on a charge image carrier from an exposure by a character generator in an electrophotographic printing or copying device and are developed with toner into printed dots on the charge image carrier.

3. The method according to claim 1 in which the individual printed elements of the print raster made up of the printed elements are generated as printed dots by a character generator in an inkjet printing or copying device.

4. The method according to claim 1 in which a table is used to calculate a size of the printed dots said table being created with the following steps:

a plurality of the first test patterns are created with printed dots of predetermined but different dot sizes and the areal coverages of the first test patterns are determined as first measurement results;

a plurality of the second test patterns are generated with printed dots of the predetermined different dot sizes, and the areal coverages of the second test patterns are determined as second measurement results;

ratios of the first and second measurement results are calculated; and the ratios are stored as a table depending on the predetermined printed dot sizes.

5. The method according to claim 1 in which to determine the character width:

the first and the second test patterns are generated;

the areal coverages of the two test patterns are measured with an optical reflex sensor;

the ratio of the areal coverages is determined; and the printed dot size is determined with aid of the ratio from a table and the character width is determined with aid of the printed dot size.

6. The method according to claim 1 in which the test patterns are respectively applied as marks to an image substrate.

7. The method according to claim 1 in which the first test pattern is realized as a checkerboard pattern.

8. The method according to claim 7 in which the second test pattern is realized as a line pattern.

9. The method according to claim 1 wherein the entire area in which the printed dots of the first test pattern are located and the entire area in which the printed dots of the second test pattern are located are of equal size.

10. The method according to claim 9 wherein a number of the printed dots in the first and the second test patterns is the same.

11. The method according to claim 1 wherein a density of the printed dots in the first test pattern and the second test pattern is the same.

12. A method to determine character width of characters constructed of printed dots in an electrophotographic printing or copying device, in which individual printed elements of a print raster made up of the printed elements on a charge image carrier are exposed and developed with toner into the printed dots to generate the characters via a character generator, comprising the steps of:

generating in a first raster cell of the print raster a first test pattern that does not cover an entire area from multiple printed dots and measuring the first raster cell with regard to its printed dot toner quantity to obtain a first value;

generating in a second raster cell of the print raster a second test pattern that does not cover the entire area and in which multiple printed dots are arranged at least in part at different printed element locations in comparison to the first test pattern, and measuring the second test pattern with regard to its printed dot toner quantity to obtain a second value; and calculating a ratio of the first and second values of the printed dot toner quantities of the first and second test patterns and calculating printed dot size with aid of the ratio.

13. The method according to claim 12 in which a table is used to calculate the size of the printed dots, said table being created with the following steps:

creating a plurality of the first test patterns with the printed dots being of predetermined but different dot sizes and the toner quantities at the first test patterns being determined as first measurement results;

generating a plurality of the second test patterns with printed dots of the different predetermined dot sizes, and determining the toner quantities at the second test patterns as second measurement results;

calculating the ratios of the first and second measurement results; and storing the ratios as a table depending on the predetermined printed dot sizes.

14. The method according to claim 12 in which to determine the character width:

applying the first and the second test patterns on a photoconductor as a charge image carrier and applying toner;

measuring the toner quantities on the two test patterns with a capacitive toner quantity sensor;

determining a ratio of the toner quantities; and determining the printed dot size with aid of the ratio from a table, and determining the character width with aid of the printed dot size.

15. The method according to claim 12 in which the test patterns are respectively applied as marks to an image substrate.

16. The method according to claim 12 in which the first test pattern is realized as a checkerboard pattern.

17. The method according to claim 16 in which the second test pattern is realized as a line pattern.

18. The method according to claim 12 wherein a density of the printed dots in the first test pattern and the second test pattern is the same.

19. A method to determine a character width of characters constructed from printed dots in a printing or copying device, comprising the steps of:

generating a first test pattern comprising printed dots arranged in a first pattern and also generating a second test pattern of printed dots arranged in a second pattern which is different than the first pattern but wherein areas in which the printed dots of the first test pattern and the second test pattern are located are equal in size, and wherein a number of the printed dots in the first and second patterns is the same;

measuring the first test pattern with regard to an areal coverage of the printed dots to obtain a first value and measuring the second test pattern with regard to an areal coverage of the printed dots to obtain a second value; and calculating a ratio of the first and second values of the areal coverages of the first and the second test patterns and calculating printed dot size with aid of the ratio.

20. A method to determine character width of characters constructed of printed dots in a printing or copying device, and wherein toner is used to generate the printed dots, comprising the steps of:

generating a first test pattern comprising printed dots arranged in a first pattern and also generating a second test pattern of printed dots arranged in a second pattern which is different than the first pattern but wherein areas in which the printed dots of the first test pattern and the second test pattern are located are equal in size, and wherein a number of the printed dots in the first and second patterns is the same;

measuring the first test pattern with regard to a toner quantity of the printed dots to obtain a first value and also measuring the second test pattern with regard to a toner quantity of the printed dots to obtain a second value; and calculating a ratio of the first and second values of the toner quantities of the first and second test patterns and calculating printed dot size with aid of the ratio.

* * * * *